US005207256A

United States Patent [19]

Kraeutler

[11] Patent Number: 5,207,256

[45] Date of Patent: May 4, 1993

[54] SAFETY DEVICE FOR A RAISABLE CURTAIN DOOR

[75] Inventor: Bernard Kraeutler, Dunieres, France

[73] Assignee: Nergeco (SA), France

[21] Appl. No.: 970,952

[22] Filed: Nov. 3, 1992

Related U.S. Application Data

[63] Continuation of Ser. No. 748,972, Aug. 23, 1991, abandoned, which is a continuation-in-part of Ser. No. 566,623, Aug. 10, 1990, Pat. No. 5,072,767.

[51] Int. Cl.[5] ..... A47H 5/00

[52] U.S. Cl. ..... 160/84.1; 160/264

[58] Field of Search ..... 160/84.1, 264, 349.1, 160/349.2, 310, 272

[56] References Cited

U.S. PATENT DOCUMENTS

| | | | |
|---|---|---|---|
| 1,298,550 | 3/1919 | Newell | 160/349.1 X |
| 1,482,978 | 2/1924 | Edwards | 160/84.1 |
| 2,687,170 | 8/1954 | Johnson | 160/84.1 |
| 2,746,538 | 5/1956 | Johnson et al. | 160/84.1 |
| 3,577,307 | 5/1971 | Baier et al. | 160/349.1 |
| 4,313,485 | 2/1982 | Gidge et al. | 160/349.1 X |
| 4,397,347 | 8/1983 | Brabant | 160/84.1 X |
| 4,478,268 | 10/1984 | Palmer | 160/272 X |
| 4,712,598 | 12/1987 | Bonacci et al. | 160/84.1 |
| 4,934,435 | 6/1990 | Regev | 160/84.1 |

FOREIGN PATENT DOCUMENTS

| | | | |
|---|---|---|---|
| 2410117 | 6/1979 | France | 160/84.1 |

*Primary Examiner*—David M. Purol
*Attorney, Agent, or Firm*—Iandiorio & Dingman

[57] ABSTRACT

A goods-handling door of the type comprising a raisable curtain constituted by a flexible curtain having horizontal reinforcing bars disposed at regular intervals, e.g. a roll-up door or a raisable door that folds concertina-like, wherein the lowermost bar is flexible and lighter than the other bars.

6 Claims, 1 Drawing Sheet

SAFETY DEVICE FOR A RAISABLE CURTAIN DOOR

RELATED APPLICATION

This application is a continuation of U.S. Ser. No. 748,972, filed Aug. 23, 1991, now abandoned, which is a continuation-in-part of U.S. Ser. No. 566,623, filed Aug. 10, 1990, now U.S. Pat. No. 5,072,767.

The present invention relates to goods-handling doors of the type comprising a raisable curtain, such as rolling doors, and raisable doors that fold concertina-like, comprising a flexible curtain having horizontal reinforcing bars disposed at regular intervals.

BACKGROUND OF THE INVENTION

Concertina-like folding doors include lifting straps fixed to the bottom bar and passing through rings fixed to at least some of the other bars. All such doors include drive means having a winding shaft disposed above the curtain and onto which the curtain itself or the straps are wound. The edges of the curtain and/or the ends of the reinforcing bars are capable of moving in slideways integral within or by lateral uprights which support a top horizontal cross-member on which the winding shaft is mounted, possibly together with an electric motor and control means for the motor.

In order to be able to perform their functions correctly, the reinforcing bars must have a degree of stiffness and a weight sufficient to carry and support the curtain during winding and unwinding operations. Unfortunately, e.g. due to clumsy operation, it may happen that the curtain is lowered too quickly and falls down onto a person or a vehicle that has not cleared the doorway. This can give rise to personal injury or to damage to vehicles and/or to the door itself. An object of the present invention is to avoid such drawbacks.

SUMMARY OF THE INVENTION

According to the present invention, a flexible bar is disposed a short distance beneath the lowermost reinforcing bar. A small additional piece of curtain at the bottom of the curtain may be provided with a flexible loading bar that is not connected to any of the lifting straps.

Such a bar should not be rigid so that if it encounters an obstacle while it is going down, then the obstacle does not have to support the entire weight of the bar.

BRIEF DESCRIPTION OF THE DRAWING

An embodiment of the invention described by way of example with reference to the accompanying drawings, in which.

MORE DETAILED DESCRIPTION

Figure 1:
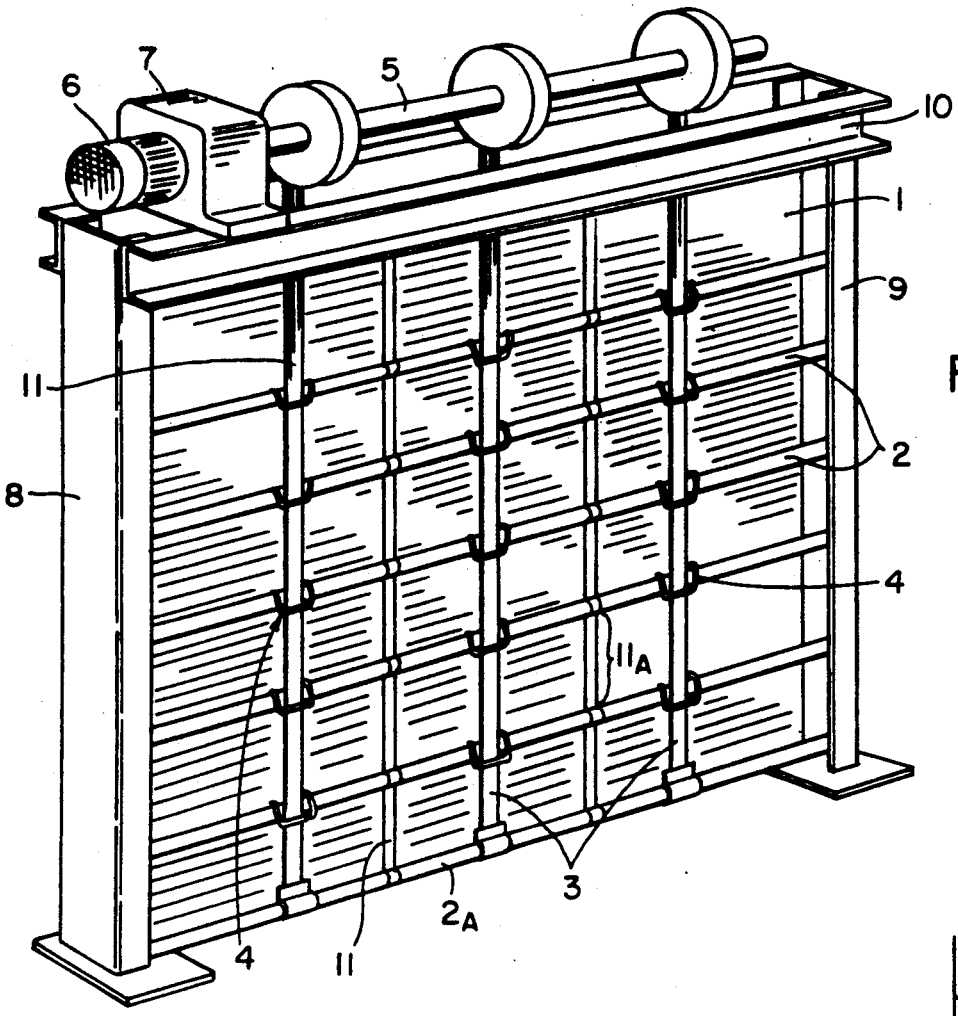
FIG. 1 is a perspective view of a door of the type to which the invention may be applied.

In order to situate the present invention, FIG. 1 shows a conventional type of curtain door by way of example. A curtain 1 is reinforced by horizontal reinforcing bars 2 disposed at regular intervals. Lifting straps 3 are fixed to the bottom bar 2A and pass through rings 4 fixed to the other bars. A drive unit may include shaft 5, on which the straps are wound, motor 6, and transmission 7. Other components for end-of-stroke detection, relays, etc. which are conventional in this type of application are not shown. The ends of the bars and possibly also the edges of the curtain move in slideways 8, 9 integral within or mounted lateral vertical uprights. A top cross-member 10, constituted in this case by two rolled steel girders, interconnects the tops of the uprights and supports the shaft 5 onto which the straps are wound, and also the motor and transmission 6, 7.

When the shaft 5 is winding up the straps, the bottom bar 2A is raised, and at consecutive intervals it reaches each successive bar so that it entrains first one bar upwards, then two, etc. and finally it entrains all of the bars. The curtain 1 folds between the bars.

Figure 3:
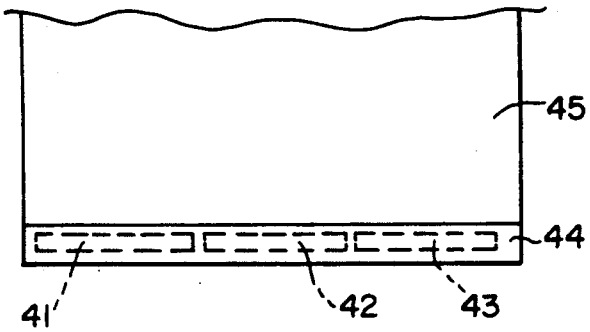
FIGS. 3-4 are front views of the lower part of a curtain door constituting different embodiments of the invention.
Figure 2:
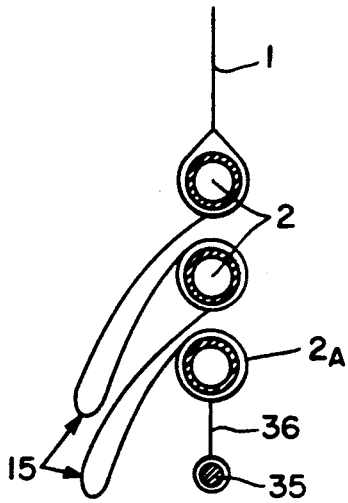
FIG. 2 is a fragmentary section through the bottom of the FIG. 1 door on a plane perpendicular to the door, with the curtain being modified in accordance with the present invention, and with the curtain being shown partially raised.
Figure 4:
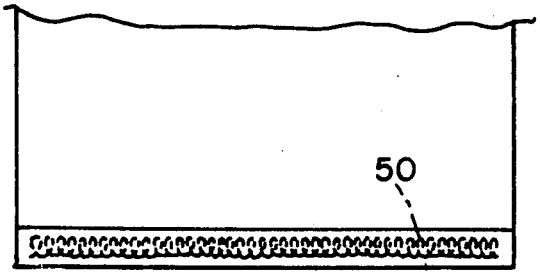

When bottom most bar 2A is raised, curtain 1 forms fold 15, FIG. 2, between the bars 2 and lowermost bar 22. In accordance with the present invention, an additional flexible bar 35 is added disposed below the bottom reinforcing bar 2A, with the additional bar being preferably lighter in weight than the bottom reinforcing bar 2A, and being fixed to the curtain or to the bottom reinforcing bar 2A, e.g. by means of a piece of cloth 36. The additional bar is capable of deforming or folding in a vertical plane and also in a horizontal plane, and it deforms as much as the curtain. Since the additional bar 35 is flexible, it is preferable for it to be supported along its entire length. In an advantageous embodiment, this additional bar is constituted by a helical coil spring 50, FIG. 4 or the like, received in a sheath formed at the bottom of the piece of cloth 36. In another advantageous embodiment shown in FIG. 3, the additional bar is constituted by a plurality of pieces 41, 42, and 43 represented by dotted lines in the bar. These pieces are disposed end to end in said sheath 44 formed at the bottom edge of the curtain 45, thereby constituting a bar that is hinged and thus flexible. The number of pieces making up the bar is at least two, and may be greater than two.

Naturally the same disposition can equally well be adopted with a door having a curtain that is reinforced by horizontal bars and which itself winds onto a shaft disposed at the top of the door.

Since the flexible additional bottom bar is lighter, the consequences of any shock received by the door will be reduced, particularly since the bar is flexible so only a portion of the bar will be involved with a shock.

If the door is subjected to abnormal thrust, e.g. a vehicle reversing without proper care, the flexible bar deforms as much as the curtain and may come out of the slideways together with the curtain without being damaged and without damaging the curtain. Naturally, it is possible for the reinforcing bars to escape from the slideways without being damaged, providing they have been designed to do so.

The ends of the flexible bar may extend into the slideways or the flexible bar may come to an end without engaging in the slideways. In general, the edges of the curtain are engaged in the slideways and the ends of the flexible bar may be engaged therein as well. It is possible to provide such a flexible bar with rigid ends. For example, the flexible bar could be constituted by a helically wound metal wire such as a coil spring and two rigid endpieces may be fitted to its ends, in order to provide better guidance in the slideways.

The invention covers the combination in a raisable curtain of a bottom bar that is flexible together with horizontal reinforcing bars or equivalent means.

The invention may be applied to a roll-up door. The curtain of such a door may include a certain number of equidistant horizontal reinforcing bars, or a single rigid load bar placed at the bottom of the curtain. Under such circumstances, the load bar can be relatively heavy, for example, with certain types of curtains it may weigh as much as 50 kg. In contrast, a flexible bar of the invention may weigh only 5 kg. A shock received by the door that may occur during an untimely lowering operation will only involve a portion of this 5 kg mass because of its flexibility, as compared with the entire 50 kg in the absence of a flexible bar of the invention.

For a door that folds concertina-like, the lower bars constitute a bundle during descent since they are packed against one another, with the bottom rigid bar to which the lifting straps are fastened carrying the bars above it. The flexible bottom bar of the invention disposed 30 cm to 50 cm beneath said bottom rigid bar, for example, thus also serves to considerably reduce the damage that may result from a shock on lowering.

After an initial shock has occurred while the curtain is being lowered, the curtain is immediately stopped by conventional mechanical or optical safety devices.

I claim:

1. A goods-handling door comprising:

two vertical lateral uprights, each of them having a vertical slideway;

a raisable flexible curtain having a bottom edge;

curtain lifting means including an electric motor for lifting said curtain in order to leave way to a person or a goods-handling vehicle;

a plurality of horizontal reinforcing bars, each of said bars being fixed to said curtain, each of said reinforcing bar having two ends which slide in said slideways, said plurality of reinforcing bars including intermediate reinforcing bars and a lowermost reinforcing bar disposed at a distance above said bottom edge of said curtain; and an additional, flexible bar, disposed at said bottom edge of said curtain, said flexible bar being flexible and deformable so that a shock received at the bottom edge of the curtain will not injure a person or damage a goods-handling vehicle.

2. The goods-handling door according to claim 1, wherein said flexible bar is lighter than said lowermost reinforcing bar.

3. The goods-handling door according to claim 1, wherein said flexible bar includes a coil spring receivable within a sheath formed along said bottom edge of said curtain.

4. The goods-handling door according to claim 1, wherein said flexible bar includes a plurality of rigid members disposed end to end in a sheath formed along the bottom edge of said curtain.

5. The goods-handling door according to claim 1, wherein said curtain lifting means further include a horizontal winding shaft actuated by said electric motor and disposed above the curtain, for winding up said curtain around said wind shaft.

6. The goods-handling door according to claim 1, wherein said curtain lifting means further include vertical belts and a horizontal winding shaft for winding said belts, said horizontal winding shaft being disposed above said curtain and actuated by said electric motor, said belts being attached to said lowermost reinforcing bar and passing slidably by said intermediate reinforcing bars, such that the curtain is folded concertina-like when said belts are wound up around said belts are wound up around said wind shaft.

* * * * *